United States Patent [19]

Gawad et al.

[11] Patent Number: 4,494,175

[45] Date of Patent: Jan. 15, 1985

[54] RECESSED LIGHTING FIXTURE WITH IMPROVED LOUVER MOUNTING

[75] Inventors: Mahmoud A. Gawad, Montreal; John Graudins, St-Laurent, both of Canada

[73] Assignee: GTE Products Corporation, Stamford, Conn.

[21] Appl. No.: 569,002

[22] Filed: Jan. 9, 1984

[51] Int. Cl.[3] ..... F21S 1/02

[52] U.S. Cl. ..... 362/150; 362/148; 362/225; 362/249; 362/290; 362/291; 362/292; 362/342; 362/346; 362/347; 362/365; 362/404; 362/433

[58] Field of Search ..... 362/150, 148, 225, 249, 362/290, 291, 292, 342, 346, 347, 365, 404, 433

[56] References Cited

U.S. PATENT DOCUMENTS 4,268,897 5/1981 Schierwagen ..... 362/342

4,429,354 1/1984 Garnett ..... 362/342

*Primary Examiner*—Stephen J. Lechert, Jr.

*Attorney, Agent, or Firm*—Lawrence R. Fraley

[57] ABSTRACT

A recessed lighting fixture used in association with a suspended ceiling system made up of several spaced grid members. The lighting fixture is comprised of a fixture housing having means for supporting at least one fluorescent lamp and includes a relatively thin deflectable top plate which in turn may include a reflecting surface disposed over the fluorescent lamp. Means are provided for securing the fixture housing to the grid members. The louver assembly of the fixture is mounted in a simplified manner and includes a top portion designed to contact the deflectable top plate during insertion and a bottom portion including longitudinally extending sides designed to rest upon and be supported by the spaced grid members. The louver's bottom portions are insertable on the grid members in sequence, first one and then the other, whereby the louver assembly is firmly supported in the fixture housing without the requirement of additional hardware such as springs, latches or the like.

14 Claims, 6 Drawing Figures

17A
25
17
5
25
12
15
56
57
41
40
36
32
33
60
74
50
57
56
28B
28
30
28A
62
20
5
56
57
50
63
76
74
82
60
33
41
40
36
32

17
12
21
25
28
50
52
76
74
82
30
15
36
40
80
70
34
32
33
60
20
56

RECESSED LIGHTING FIXTURE WITH IMPROVED LOUVER MOUNTING

TECHNICAL FIELD

The present invention relates in general to recessed lighting fixtures and particularly to recessed lighting fixtures which include a louver as part thereof.

A common practice in illuminating spaces, particularly in commercial and industrial buildings provided with suspended or dropped ceilings, is to mount the lighting fixtures (particularly lighting fixtures which utilize fluorescent lamps as the light source) in corresponding openings in the ceiling with the bottom of the fixture approximately co-planar with the ceiling. In most cases, the suspended ceiling system is comprised of a framework or grid of inverted metallic "T" bars (those of a T-shape when viewed in cross-section) or the like which are utilized to support the entire ceiling system as well as the associated lighting fixtures.

BACKGROUND

It is common practice for recessed fluorescent lamp fixtures, particularly those which employ deep parabolic-shaped louvers, to have the louver assembly fastened to the body of the luminaire by a combination of hinges, latches, and/or springs. In this regard see, for example, U.S. Pat. No. 4,238,815 (Price). Reference may also be made to U.S. Pat. Nos. 4,171,535 (Westermann) and 4,363,082 (Rollins) which illustrate other presently existing luminaires. These additional components and the associated time necessary to assembly same add appreciably to the complexity of the lighting fixture and also to the cost thereof. It is also usual, under present practice, to limit the height of the parabolic louver, particularly the sides and cross pieces (or fins) which interconnect the sides, to the space below the fluorescent lamp. Accordingly, the sides typically do not extend above the lamp level in order to avoid interference between the louver and the lamp when the louver is swung open for servicing (or during installation). This height limitation, however, results in low fixture efficiency due to the corresponding reduction in total louver light control surface area.

At the present time, attempts to provide improved fixture efficiency have included extending louver light control surfaces upwardly by means of separate strips of louver material blanked and formed to follow the louver contour. These strips are attached to the fixture housing to function essentially as a louver extension. However, this solution is costly and does not provide the best results due to differences in curvature between the basic louver and the extension, misalignment between these members, and other problems inherent in this type of construction. Another attempt to improve efficiency involves extending non-removable, longer sides of the louvers upwardly beyond the lamp, but unfortunately this necessitates the elimination of the aforementioned cross pieces in order to permit lamp servicing. In addition, the undesirable lamp brightness is increased primarily because of the absence of such cross pieces.

DISCLOSURE OF THE INVENTION

It is an object of the present invention to provide a recessed louvered lighting fixture with improved louver mounting capability and in which the fixture operates with improved efficiency.

Another object of the present invention is to provide a recessed lighting fixture which provides the above features and yet can be produced at relatively low cost.

A further object of the present invention is to provide a recessed fluorescent fixture with improved louver mounting whereby the louver is positively secured in position without the use of special added components such as springs, hinges, latches or the like.

Still another object of the present invention is to provide an improved recessed lighting fixture that enables the use of full depth louver sides in combination with cross pieces (fins) to thereby obtain enhanced efficiency with substantially no reduction in cross shielding.

Still another object of the present invention is to provide an improved recessed lighting fixture in which possible interference between lamp and louver is substantially eliminated as a result of a novel louver mounting technique.

Still another object of the present invention is to provide an improved recessed fixture which is particularly adapted for mounting in known suspended ceilings which utilize a plurality of spaced grids of the "T" bar type.

In accordance with the main aspect of the present invention, there is provided a recessed lighting fixture which is adapted for use in association with a suspended or dropped ceiling system that has a grid support comprised of several separate, spacedly-disposed grid members. The lighting fixture comprises a fixture housing having means at the top thereof for supporting spaced fluorescent lamp holders. The housing is open at the bottom thereof and is also defined by a relatively thin deflectable member preferably in the form of a relatively flat top plate, which, in addition to providing a part of the housing, also defines an optically reflecting surface disposed over the fluorescent lamp. Means are provided for securing the fixture housing to the grid support between grid members. This means may comprise "T" clamps (hereinafter referred to as T-bar clamps) adapted to secure the ends of the fixture housing to the "T" bars defining the grid members. The louver means has a top portion, preferably defined by a pair of side walls, each having respective top flanges for contacting the deflectable top plate, and a bottom portion including longitudinally extending sides adapted to rest upon and be supported by respective spaced grid members. The sides of the louver further include bottom lipped flanges which are insertable within the opening between the spaced grid members and adapted for being positioned thereon. This insertion is performed in sequence, with one flange inserted first and then the other, so that the louver is supported in the fixture housing without the requirement of supporting springs, latches, hinges or the like.

BEST MODE FOR CARRYING OUT THE INVENTION

Figure 1:
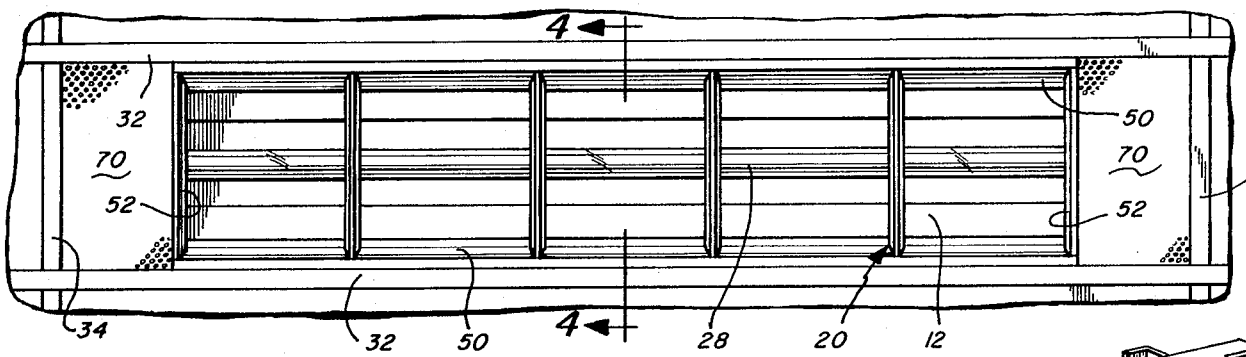
FIG. 1 is a bottom view of the recessed lighting fixture in accordance with a preferred embodiment of the present invention as supported within a suspended ceiling.

For a better understanding of the present invention, together with other and further objects advantages and capabilities thereof, reference is made to the following disclosure and appended claims in connection with the above described drawings.

Referring now to the drawings, there is illustrated a preferred embodiment of the recessed lighting fixture of the present invention. This recessed lighting fixture (or luminaire) is adapted for use with one or more fluorescent lamps and is characterized in particular by an improved means for mounting the fixture's louver assembly to thus provide a high efficiency, low cost fixture design. The fixture in accordance with the present invention provides for a louver mounting arrangement in which the louver is positively secured in place without the use of special additional hardware such as springs, hinges, latches or the like and yet in which the louver is of a relatively simple construction. The design as described herein allows full length louver sides to be used preferably together with associated cross pieces (fins), thereby obtaining high efficiency with substantially no reduction in cross shielding.

The improved construction in accordance with the present invention is brought about by a number of features described below. In accordance with one feature, the louver assembly is not fastened to the fixture housing as is the usual practice, but instead is supported by the ceiling T-bar grid independent of the fixture's housing. In addition, the fixture top, instead of substantially surrounding the louver in the usual manner, is simply constructed as a flexible plate, the purpose of which is to rest against the louver's top. This unique arrangement serves to positively retain the louver in place, center it, and also provide a top closure therefor.

Yet another feature of the present invention involves the construction of the fixture's housing. This component is of a relatively skeleton construction, fastened to the T-bar grids by simple clamps, thus allowing the housing to maintain all of the geometrical proportions needed. The result of these and other features is a fixture in which the design is simplified by reducing material needed to produce the fixture, eliminating louver suspension hardware heretofore deemed necessary to complete mounting, and allowing efficient, one-piece louver members with cross pieces to be used without causing lamp interference. All of this is achieved without any visible change in shape of the fixture to the user, in comparison to existing designs.

Figures 5, 6:
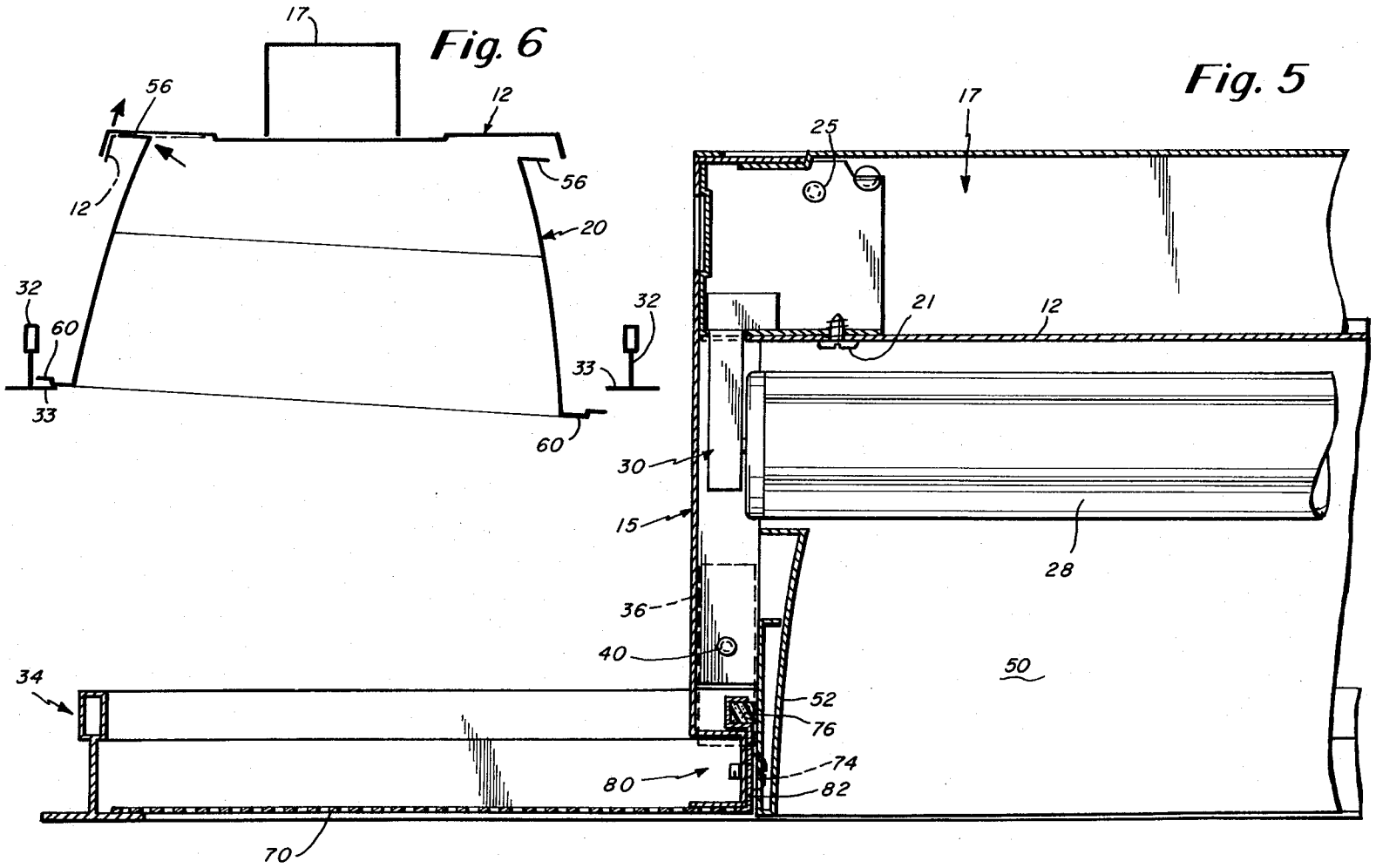
FIG. 5 is a side elevational view, partly in section, taken along line 5—5 in FIG. 4 and illustrating further details of the recessed lighting fixture of the invention.
FIG. 6 is a schematic diagram illustrating the manner in which the louver member of the invention is mounted in the invention's housing and associated, suspended ceiling grid system.

With particular reference to the drawings, the invention comprises a housing 10 and a louver assembly 20. The fixture housing 10 comprises a deflectable substantially flat top plate 12 and opposed end pieces 15. To assemble the invention, the top plate 12 is first attached to the elongated, metallic channel strip 17 of the housing by means of only two spaced-apart screws 21 which pass through respective apertures in the top plate 12 at opposite ends thereof. Screws 21 extend into and are secured to the channel strip 17. In FIG. 5, one of the screws 21 is clearly illustrated extending into channel strip 17. These screws 21, as well as other screws used in the assembly of the invention, are preferably sheet metal screws. Use of top plate 12 is deemed to constitute a significant aspect of this invention. Plate 12 is of thin (i.e., approximately 0.026 inch thick) metallic (i.e., sheet steel) material such that it is capable of deflecting upwardly along each side thereof during insertion of the invention's louver assembly. This mode of deflection in effect constitutes a pivoting action by the top plate along the imaginary center line interconnecting the two points of securement (screws 21 into channel strip 17) of the plate. As described below and illustrated in FIG. 6, upward deflection of one side of the plate results in corresponding downward deflection of the opposing longitudinal side. Accordingly, the top plate exerts a downward force, though very slight, on the louver assembly to assist in maintaining the assembly in position.

Once the top plate 12 is attached to channel strip 17, the end pieces 15 are attached at the tops thereof to respective end portions 23 of the channel strip. In this regard, each of the end pieces 15 is provided with a U-shaped top portion 22 which is adapted for engaging the aforementioned end portions. Four screws 25 are used, each extending through associated side tabs of the respective end piece's top portion. These screws, as shown, each extend through a respective opening provided within the respective side tab.

Figure 3:
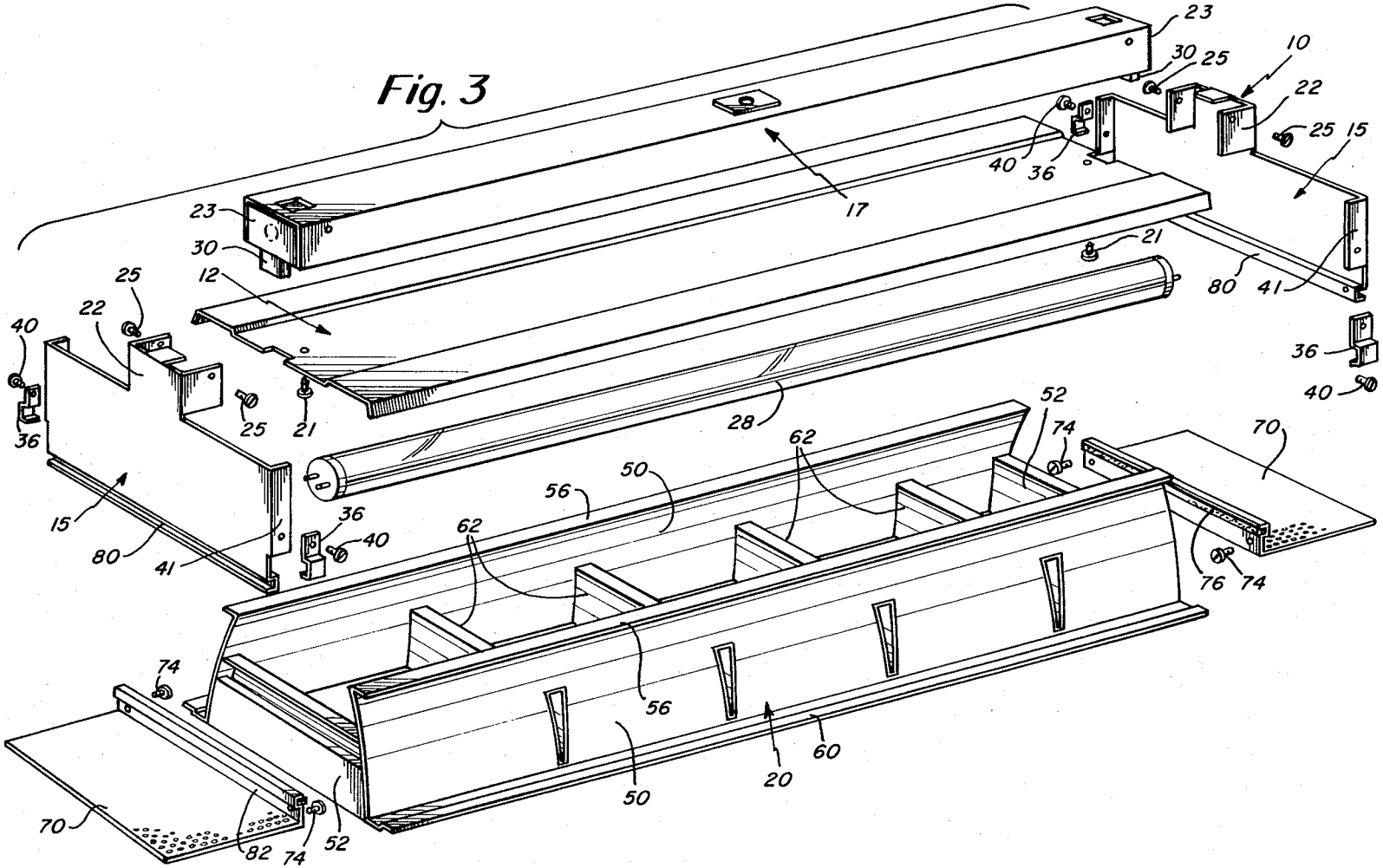
FIG. 3 is an exploded perspective view showing the different parts of the recessed lighting fixture of the present invention.
Figure 4:
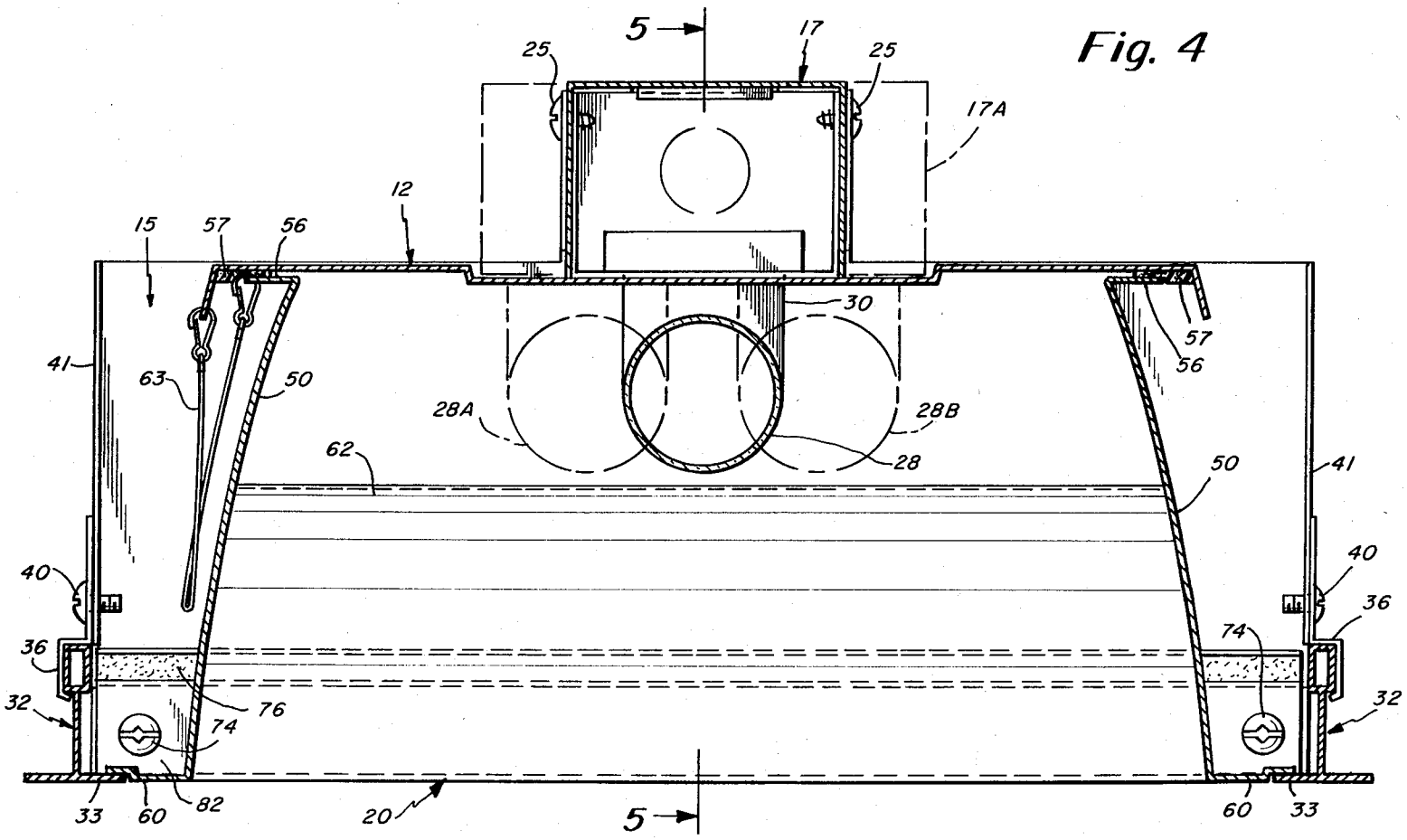
FIG. 4 is an end elevational view, partly in section, taken along line 4—4 in FIG. 1 and illustrating further details of the recessed lighting fixture of the invention.

The exploded view of FIG. 3 also shows the preferred light source for use with the invention, fluorescent lamp 28, which, as also illustrated in FIG. 5, is inserted into a pair of opposed sockets 30, located within the channel strip. FIG. 4 shows the use of a single fluorescent lamp 28, but also illustrates, in phantom, a larger channel strip 17A adapted for having a pair (2) of sockets at each end for supporting a respective pair of fluorescent lamps (28A and 28B). In this regard, top plate 12 is uniquely constructed to accommodate channel strips of either size.

The fixture housing 10 as now assembled (and absent louver assembly 20) is ready for being secured to the designated suspended ceiling grid system. As particularly illustrated in FIGS. 1 and 2, the grid system is comprised of spaced T-bar grid rails including parallel side rails 32 and corresponding parallel cross rails 34 which interconnect and thus serve as braces for the side rails. Each of these rails has an inverted T-shape, as shown. See especially FIG. 4. FIG. 2 also shows a plurality of hanger wires 33 attached to the rails 32 and used to support the various grid rails from the ceiling of the building utilizing this structure. The fixture housing is secured to the T-bar side rails 32 by means of T-bar clamps 36 and associated securing screws 40. The exploded view of FIG. 3 shows the T-bar clamps 36 while the cross-sectional view of FIG. 4 shows these clamps secured in position about the T-bar rails 32. The securing screws 40 extend through the upper end of the respective clamp 36 and into side flanges 41 of the end pieces 15. It is noted in FIG. 3 that there are only four T-bar clamps used, two associated with each end piece 15, at opposite sides thereof. This arrangement thus provides a solid, four-point connection between housing and grid system.

The louver assembly 20 as illustrated in the exploded view of FIG. 3 comprises a pair of opposed side sections 50 and associated end sections 52. The side sections 50, designed for providing light control (directional), follow a parabolic contour and have at the top thereof outwardly extending flanges 56. In addition, at the bottom of each side section is an outwardly extending lipped flange 60. Louver assembly 20 also includes four cross pieces (fins) 62 which also provide light control, said pieces extending between and thus interconnecting side sections 50.

With the fixture housing secured in place by T-bar clamps 36, the louver assembly 20 is inserted into position from below the T-bar grid so that the lipped flanges 60 rest upon side flanges 33 which form part of each grid rail 32. In this connection, FIG. 6 represents a schematic illustration showing the first step of louver insertion in which the lipped flange 60 on one side (to the left of the viewer in FIG. 6) rests upon an associated flange 33. In this regard, louver assembly 20, being forced upwardly against the opposed sides of the top plate 12 in the abutting relationship shown, as well as being enclosed at the ends thereof by end pieces 15 of the invention's housing, is defined herein as being located within the housing (when in its final, operating position). This is not meant to limit the scope of the invention, however, as it is clearly understood that louver assembly 20 is not secured to or, more importantly, not totally surrounded by the various components which constitute the housing of the invention. By the term within the housing is thus meant to include both a mere abutting relationship and a situation wherein the housing may include downwardly extending side panels which serve to surround the louver assembly along with the top plate and side piece elements. It is noted that when the lipped flange is inserted upon the top of the T-bar, the upper flange 56 on the same side engages the corresponding side of the resilient top plate 12. The thin top plate deflects slightly upwardly to facilitate louver insertion. In FIG. 6, the right-hand lipped flange 60 is shown below its associated rail 32 but the width between the lipped flanges on either side of the louver is sufficient to enable the right-hand lipped flange to pass upwardly and rest upon its associated right-hand rail 32. This positioning is facilitated by maintaining an overall outer distance between the two opposed sides of the louver assembly greater than the distance between the internal end surfaces of the corresponding two horizontal legs of the T-shaped grid members upon which the flanged portions of these sides rest. In addition, it can be seen in FIG. 4 that the aforementioned outer distance (flange to flange of the opposed parabolic sides) is slightly less than the distance between the vertical (upright) legs of both grid members. The final position of the invention is illustrated in FIG. 4 wherein each of the lipped flanges 60 rest upon the side extending flanges of the associated T-bar rails. When the right-hand side of the louver is moved into position, the corresponding upper flange 56 is urged against and slightly deflects (upwardly) the top plate 12 on that side of the top plate. Thus, it can be seen that the louver can easily be replaced because it is not fixedly attached to the suspended ceiling as in typical prior art constructions. Removal is simply carried out by moving one side of the louver upwardly, moving the louver slightly sideways, and then passing the louver to the position of FIG. 6, from whence it can be removed (by lowering the right side sufficiently to clear the supporting grid structure).

FIG. 4 also illustrates additional features of the present invention, including the preferred use of gaskets 57 disposed between the opposed flanges 56 and the mating underside of the deflecting top plate 12. The gaskets 57 may each be of neoprene or similar material and are attached preferably to the top plate 12 by means of an adhesive. FIG. 4 also illustrates one of the two safety cords 63, each of which is secured at one end to the top plate 12 and at the other end to the louver assembly 20. These safety cords enable the louver to be suspended in a relatively simple manner for the purpose of cleaning either the louver or the fixture housing.

Figure 2:
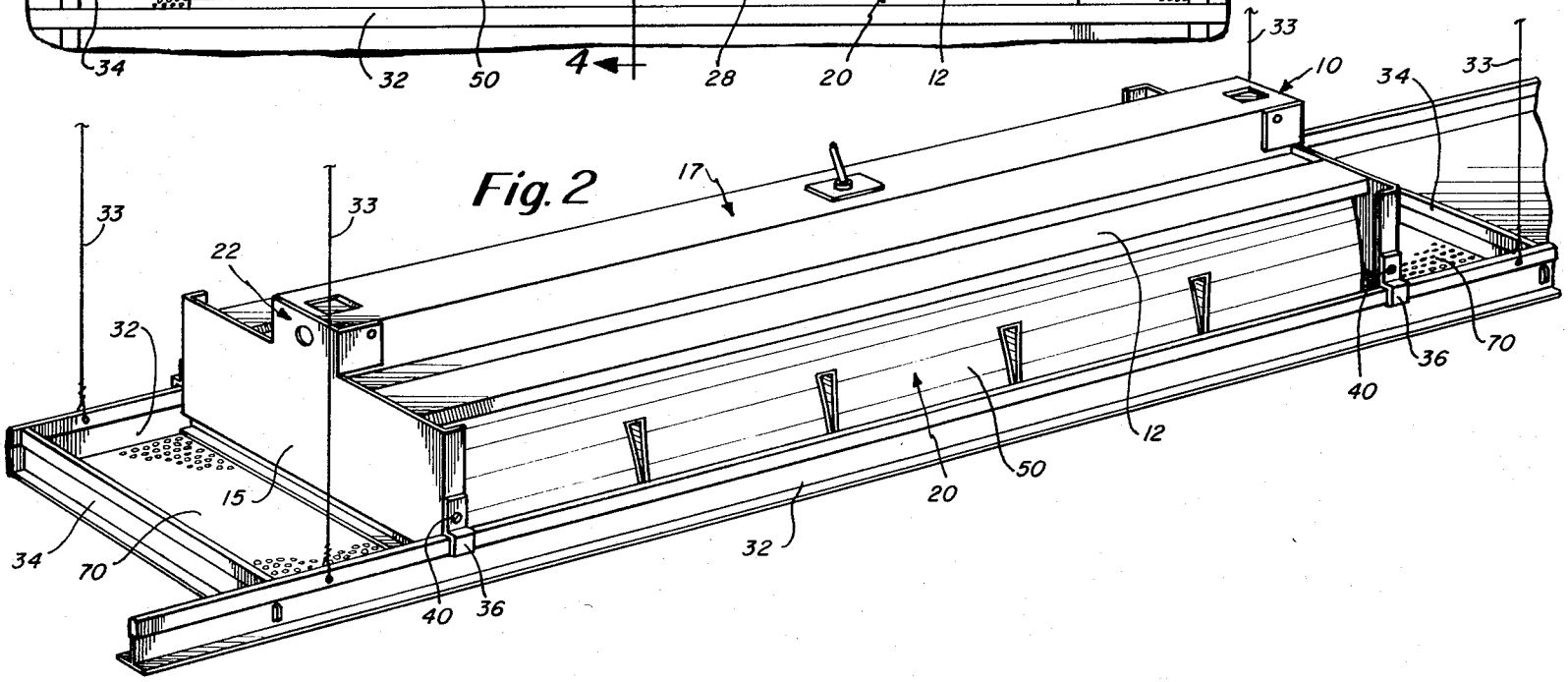
FIG. 2 is a perspective view showing the recessed lighting fixture of FIG. 1, secured in position in a suspended ceiling comprised of spaced "T" bars (grid members)

FIGS. 1–3 and 5 also disclose the use of extension plates 70 which are dimensioned so as to fill any void which may occur between the lighting fixture's ends and the adjacent cross rails 34, such as illustrated in FIGS. 1 and 2. One side of each extension plate 70 rests upon a respective cross rail 34 (FIG. 5) and the other side is fastened to the end piece 52 of the louver assembly 20. FIG. 3 illustrates the use of four screws 74 that are used to secure both extension plates to end pieces 52. FIG. 5 further illustrates the manner in which this securement is achieved. That is, screws 74 each pass through a respective end piece 15 in the channel 80 and also through the wall 82 of the extension plate 70. The gasket 76 (see also FIG. 4) is adapted to provide a seal between the extension plates and the louver's end pieces. Each of the extension plates 70 is preferably perforated with several small (i.e., 0.075 inch diameter) perforations. A total of between 100 and 120 perforations per square inch is preferred.

Unless noted otherwise above, most parts of the invention, including channel strip 17, end pieces 15, and top plate 12 are comprised of sheet steel. The louver assembly 20 is comprised of aluminum or similar lightweight metallic material. Sockets 30 and lamp 28 can be of material well known in the art, as standard examples of each are readily available on the marketplace.

While there have been shown and described what are at present considered the preferred embodiments of the invention, it will be obvious to those skilled in the art that various changes and modifications may be made therein without departing from the scope of the invention as defined by the appended claims. For example, it is understood that although only a ceiling structure containing side rails (32) of T-shaped configuration has been illustrated, the invention is adaptable for use in ceiling structures wherein rails or similar elements of different shapes are utilized. By way of specific example, the invention can be utilized with side rails of L-shaped configuration (wherein both face inwardly) which in turn are attached to or form part of a larger component which is secured to the ceiling itself or forms part thereof. Fixtures employed in such structures are often referred to as semi-recessed, suspended, or surface-mounted fixtures.

What is claimed is:

1. A recessed lighting fixture adapted for use in association with a suspended ceiling structure having a grid support comprised of spacedly positioned grid members, said lighting fixture comprising a fixture housing having means at the top thereof for supporting a pair of spaced lamp socket members, said housing open at the bottom thereof, a relatively thin, deflectable top plate member secured to said housing or forming a part thereof and defining an optically reflecting surface disposed adjacent said lamp socket members, means securing said fixture housing to said grid support between said spacedly positioned grid members, and louver means having a top portion adapted to contact said deflectable top plate member and a bottom portion including longitudinally extending sides for resting upon and being supported by a respective one of said spacedly positioned grid members, said louver means not fixedly attached to said suspended ceiling structure, said bottom portions of said louver means being insertable on each of said grid members in sequence, one and then the other, said deflectable top plate member deflecting upwardly in a pivotal manner upon said contact with said top portion of said louver means during said insertion of said louver means on said grid members to facilitate said insertion and thereafter exerting a substantially downward force on said louver means to assist in maintaining said louver means in position on said grid members, whereby said louver means is supported in said fixture housing without the use of supporting springs, latches or the like.

2. The recessed lighting fixture as set forth in claim 1 wherein said means for supporting said lamp socket members comprises a channel strip member.

3. The recessed lighting fixture as set forth in claim 2 wherein said fixture housing includes an end piece at each end thereof.

4. The recessed lighting fixture as set forth in claim 3 including means for fastening said deflectable member to said channel strip member and for fastening each of said end pieces to said channel strip member.

5. The recessed lighting fixture as set forth in claim 4 wherein each of said grid members comprises an elongated, T-shaped bar.

6. The recessed lighting fixture as set forth in claim 5 wherein said means for securing said fixture housing to said grid support comprises a plurality of T-bar clamps, a pair of said clamps being connected to each end piece along respective sides thereof.

7. The recessed lighting fixture as set forth in claim 1 wherein said deflectable top plate member is substantially planar and substantially defines the top part of said fixture housing.

8. The recessed lighting fixture as set forth in claim 7 wherein said longitudinally extending sides of said louver means each include an upper flange portion for providing said contact with said deflectable member to cause such deflectable member to be upwardly deflected during positioning of said louver means within said fixture housing.

9. The recessed lighting fixture as set forth in claim 8 wherein said longitudinally extending sides of said bottom portion of said louver means each include a flange portion, said flange portion resting upon a respective one of said grid members when said louver means is positioned within said fixture housing.

10. The recessed lighting fixture as set forth in claim 9 wherein each of said grid members comprises a T-shaped bar having a horizontal leg and a vertical leg, each of said flanges of said bottom portion of said louver means resting upon and being supported by a respective one of said horizontal legs.

11. The recessed lighting fixture as set forth in claim 10 wherein the outer distance between said flanges of said bottom portion of said louver means is less than the distance between said vertical legs of said T-shaped bars having said louver means thereon but greater than the distance between said horizontal legs of said T-shaped bars having said flanges of said bottom portion of said louver means resting thereon.

12. The recessed lighting fixture as set forth in claim 1 including a gasket between the portion of said louver means and said deflectable member.

13. The recessed lighting fixture as set forth in claim 1 wherein said sides of said louver means are each of a substantially parabolic configuration, said louver means further including a plurality of cross pieces, said sides extending substantially higher than said cross pieces.

14. The recessed lighting fixture as set forth in claim 1 including at least one safety line interconnecting said fixture housing and said louver means to enable said louver means to be suspended from said housing when removed therefrom.

* * * * *